US008706008B2

(12) United States Patent
Imai

(10) Patent No.: US 8,706,008 B2
(45) Date of Patent: Apr. 22, 2014

(54) IMAGE FORMING APPARATUS

(75) Inventor: Yuichiro Imai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 13/094,670

(22) Filed: Apr. 26, 2011

(65) Prior Publication Data

US 2011/0274461 A1 Nov. 10, 2011

(30) Foreign Application Priority Data

May 10, 2010 (JP) ..... 2010-108784

(51) Int. Cl.
*G03G 15/00* (2006.01)

(52) U.S. Cl.
USPC ..... 399/167

(58) Field of Classification Search
USPC ..... 399/100, 117, 167
See application file for complete search history.

(56) References Cited

U.S. PATENT DOCUMENTS

| | | | | |
|---|---|---|---|---|
| 5,648,839 | A * | 7/1997 | Koshino et al. | 399/271 |
| 7,228,090 | B2 * | 6/2007 | Toso et al. | 399/167 |
| 8,244,159 | B2 * | 8/2012 | Woo | 399/167 |

FOREIGN PATENT DOCUMENTS

| | | | |
|---|---|---|---|
| JP | 08-015985 | A | 1/1996 |
| JP | 2006-145774 | A | 6/2006 |
| JP | 2007-286575 | A | 11/2007 |

* cited by examiner

*Primary Examiner* — David Gray
*Assistant Examiner* — Gregory H Curran
(74) *Attorney, Agent, or Firm* — Canon USA, Inc., IP Division

(57) ABSTRACT

An image forming apparatus may transfer an image to a transfer-receiving material. The image forming apparatus includes a main body to which a cartridge is detachably mounted. The cartridge includes an image bearing member in contact with the transfer-receiving material and a receiving member to receive driving force from the main body to drive and rotate the image bearing member. The image forming apparatus also includes a shaft passing through and supporting the receiving member of the cartridge and a transmission member to rotate around the shaft and to transmit drive force from a motor to the receiving member. A bending unit included with the image forming apparatus bends the shaft passing through and supporting the receiving member and the transmission member.

3 Claims, 12 Drawing Sheets

IMAGE FORMING APPARATUS

BACKGROUND OF THE INVENTION

1. Field of the Invention

The present invention relates to an image forming apparatus having a cartridge incorporated therein.

2. Description of the Related Art

An electrophotographic image forming apparatus includes a photosensitive member as a rotatable image bearing member, and outputs images by transferring toner images formed on the photosensitive member to sheets. In such an image forming apparatus, because of use over time, the photosensitive member and image forming units configured to form toner images on the photosensitive member become deteriorated and worn. Thus, these components require regular replacement (maintenance).

To facilitate the maintenance, a product (hereinafter, referred to as a cartridge) that is a package of disposable components such as a photosensitive member is commercially available. In many cases, the cartridge is replaceably mounted to an image forming apparatus. The photosensitive member is rotatable by driving force supplied from the main body of the apparatus to form images.

In the replaceable cartridge, the photosensitive member is rotated by driving force supplied from the apparatus main body. The driving force is supplied from the apparatus main body to the cartridge through a coupling, which is a receiving member for the driving force. The coupling requires a clearance (play) to allow attachment/detachment of the cartridge to/from the apparatus main body. In such a structure, if the rotational axis of the coupling of the cartridge is positioned offset from the central axis of a coupling of the apparatus main body, a variation in rotation speed of the photosensitive member may be caused. The variation in rotation speed of the photosensitive member then results in image defects such as defective transfer and image distortion.

Japanese Patent Application Laid-Open No. 2006-145774 discusses a structure in which the rotation shaft of a coupling of a cartridge and the rotation shaft of a coupling of an apparatus are precisely aligned to suppress a variation in rotation speed of a photosensitive member.

In recent years, it has been found that a reduction in speed difference between a photosensitive member, as an image bearing member, and a transfer-receiving member (e.g., a sheet or an intermediate transfer member) improves transferability of images. More specifically, a reduction in difference between the speed of a photosensitive member and the speed of a transfer-receiving member in an image forming apparatus can suppress image defects (hereinafter, referred to as white spots), which involve no transfer of part of a toner image born on the photosensitive member onto the transfer-receiving member.

In the structure discussed in Japanese Patent Application Laid-Open No. 2006-145774, the cartridge is supported by a drive shaft of the apparatus and a coupling is provided on the shaft. A reduction in speed difference between the photosensitive member and the transfer-receiving member may cause a problem as follows.

The problem is described with reference to FIGS. 10A and 10B. FIGS. 10A and 10B each illustrate a rotation speed of a photosensitive member and a moving speed of an intermediate transfer member. The photosensitive member and the intermediate transfer member each have a given component tolerance, which periodically varies the rotation speed of the corresponding member. As illustrated in FIG. 10A, in the case with a large difference in speed between the photosensitive member and the intermediate transfer member as a transfer-receiving member, notwithstanding the periodic variation in speed, the photosensitive member constantly rotates faster than the intermediate transfer member. As illustrated in FIG. 10B, however, in the case with a small difference in speed between the photosensitive member and the intermediate transfer member, the intermediate transfer member rotates momentarily faster than the photosensitive member (the period "reverse" in FIG. 10B). In the reverse state of speed, the photosensitive member receives a force from the intermediate transfer member in a direction to cause separation of the coupling. In the structure where the cartridge is supported by a drive shaft of the apparatus and a coupling is provided on the shaft, the force exerted in that direction results in momentary separation of the coupling although the separation is well recovered soon. Accordingly, a variation in speed of the photosensitive member and the transfer-receiving member generates a force applied to the photosensitive member and causes the coupling to be momentarily separated, resulting in a state where driving force is not transmitted to the photosensitive member. This precludes the achievement of satisfactory transferability of images.

SUMMARY OF THE INVENTION

According to an aspect of the present invention, an image forming apparatus may be used to transfer an image to a transfer-receiving material. The image forming apparatus includes a main body to which a cartridge is detachably mounted, wherein the cartridge includes an image bearing member in contact with the transfer-receiving material and a receiving member configured to receive driving force from the main body to drive and rotate the image bearing member. The image forming apparatus additionally includes a motor; a shaft passing through and supporting the receiving member of the cartridge; a transmission member configured to rotate around the shaft and to transmit drive force from the motor to the receiving member; and a bending unit configured to bend the shaft passing through and supporting the receiving member and the transmission member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A general structure of an image forming apparatus is described first. Engagement between a process cartridge and the main body of the apparatus is then described in detail, which is followed by description of a structure where a shaft of the apparatus that supports the process cartridge is curved (bent) so that a force is applied to the process cartridge and a coupling portion (engagement portion) of the apparatus main body. An amount of bending of the shaft and stability of transmission of drive force were evaluated, which will be described last. The dimensions, materials, shapes, and relative arrangements of components described below are intended to be exemplary only and, unless otherwise described to limit the scope of the present invention, not limiting the scope to the following structure.

Components of an image forming apparatus of the present invention are briefly described.

Figure 1:
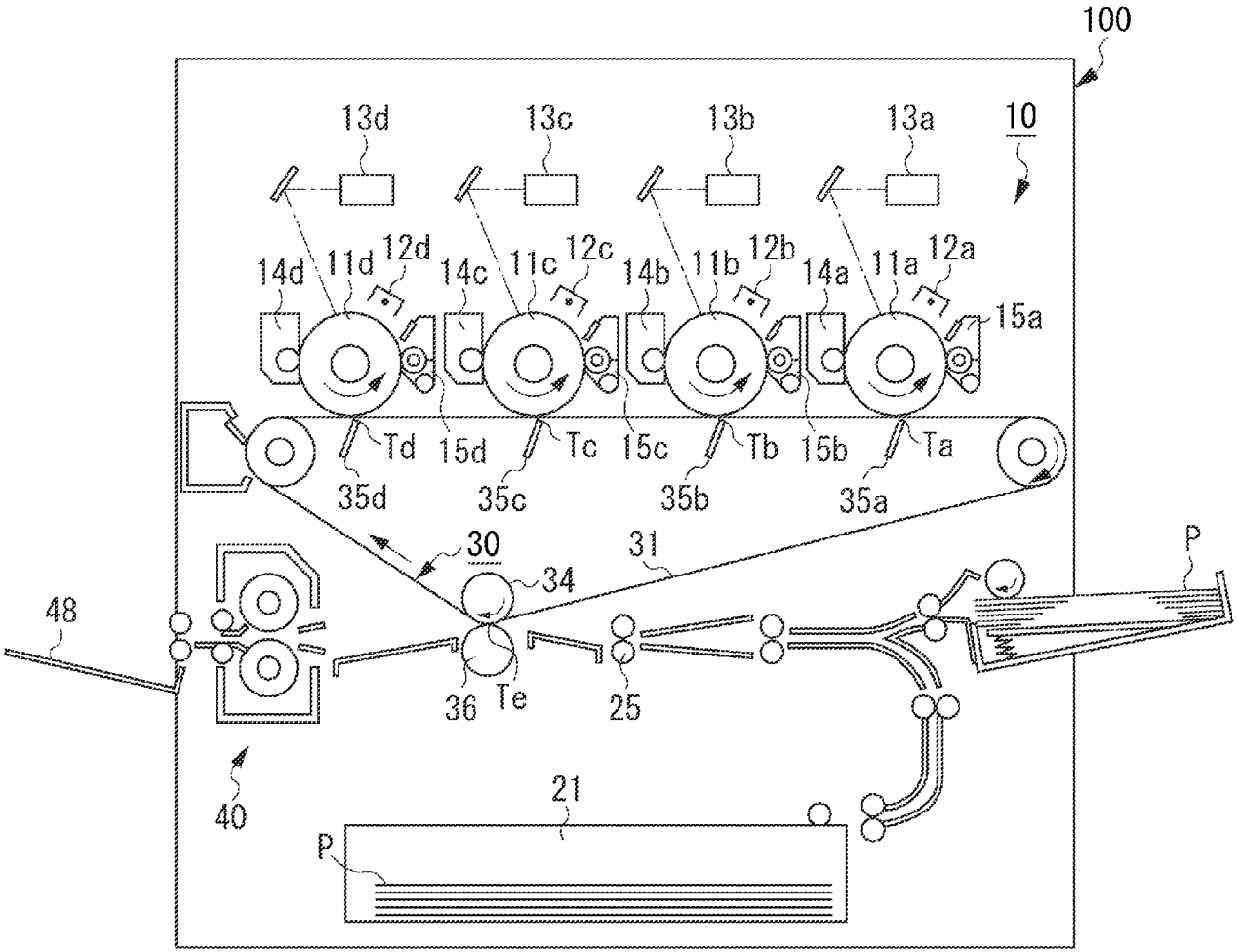
FIG. 1 is a cross sectional diagram schematically illustrating an image forming apparatus.

FIG. 1 is a cross sectional diagram schematically illustrating an image forming apparatus. The image forming apparatus includes photosensitive drums 11*a* to 11*d* as rotatable image bearing members. The photosensitive drums 11*a* to 11*d* are respectively surrounded by primary chargers 12*a* to 12*d*, laser exposing optical systems 13*a* to 13*d*, developing devices 14*a* to 14*d*, photosensitive member cleaners 15*a* to 15*d*, and an intermediate transfer unit 30. Each of the developing devices 14*a* to 14*d* is filled with a developer that contains a toner made of a base resin mixed with pigment and magnetic particles (carrier). The intermediate transfer unit 30 includes an intermediate transfer belt 31 as an image bearing member. The intermediate transfer belt 31 carries and conveys toner images formed on the photosensitive drums to a secondary transfer portion Te. The image forming apparatus further includes primary transfer blades 35*a* to 35*d*, which primarily transfer toner images formed on the photosensitive drums 11*a* to 11*d* onto the intermediate transfer belt 31, and secondary transfer rollers 34 and 36, which secondarily transfer the toner images on the intermediate transfer belt 31 onto sheets. In the present exemplary embodiment, the photosensitive drums 11*a* to 11*d* each have a diameter of 30 mm and a longitudinal length of 400 mm, and the intermediate transfer belt 31 has a longitudinal length of 360 mm.

With regard to the laser exposing optical systems 13*a* to 13*d*, an image signal emitted from a reader unit is temporarily stored in an image memory. The signal is then converted into an optical signal at a laser output unit. The laser beams of the converted signals are reflected by polygon mirrors, lenses, and reflective mirrors, to be projected onto the surfaces of the photosensitive drum 11*a* to 11*d*.

The main body 100 of the image forming apparatus operates as follows to form images. A control unit (central processing unit (CPU)) in the main body 100 of the image forming apparatus charges the photosensitive drums 11 using the primary chargers 12 while the photosensitive drums 11 are rotating. The charged photosensitive drums are exposed to laser beams to form electrostatic images. The formed electrostatic images are developed to toner images by the developing devices 14. The toner images having colors corresponding to the developing devices 14 are superposed on the sheet-type intermediate transfer belt without color misregistration. The toner images having the four colors and superposed on the intermediate transfer belt are transferred onto sheets P at the secondary transfer portion.

The sheets P are conveyed one by one from a sheet container unit 21 by a sheet feeding unit while skew thereof is corrected by a registration roller 25, to secondary transfer rollers 34 and 36 at predetermined timings. At the secondary transfer portion, toner images are transferred onto the sheets, and fixed there by a heating roller fixing device 40. The sheets having the fixed images are discharged to a sheet discharge tray 48.

A relationship between the process cartridge and the main body is described with reference to FIGS. 2A and 2B. The process cartridge in the present exemplary embodiment includes a photosensitive member as a rotator, a charging device adjacent to the photosensitive member, a developing device, and a cleaning blade. The structure of the present invention is applicable to a replaceable unit having at least a photosensitive member as a rotator that rotates when driven by a coupling portion.

In the present exemplary embodiment, the photosensitive member, the developing device, the charging device, and the cleaning device constitute an integrated replaceable process cartridge 10. The process cartridge 10 is detachably (removably) mounted to the main body of the apparatus, and includes a coupling as a connection member that receives driving force from the main body of the apparatus. The process cartridge 10 includes a photosensitive member as a rotator, and is configured to receive driving force from the apparatus main body. The process cartridge 10 rotates while receiving driving force from the apparatus main body. The process cartridge 10 is provided with the coupling that receives driving force from a motor (drive source) in the main body of the apparatus. The process cartridge 10 is described below in more detail.

Figure 2A:
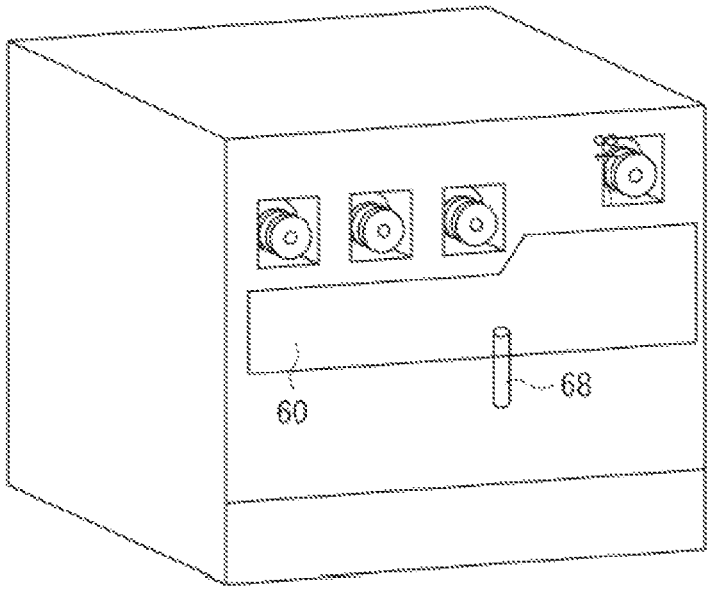
FIGS. 2A and 2B each illustrate an appearance of the image forming apparatus.
Figure 2B:
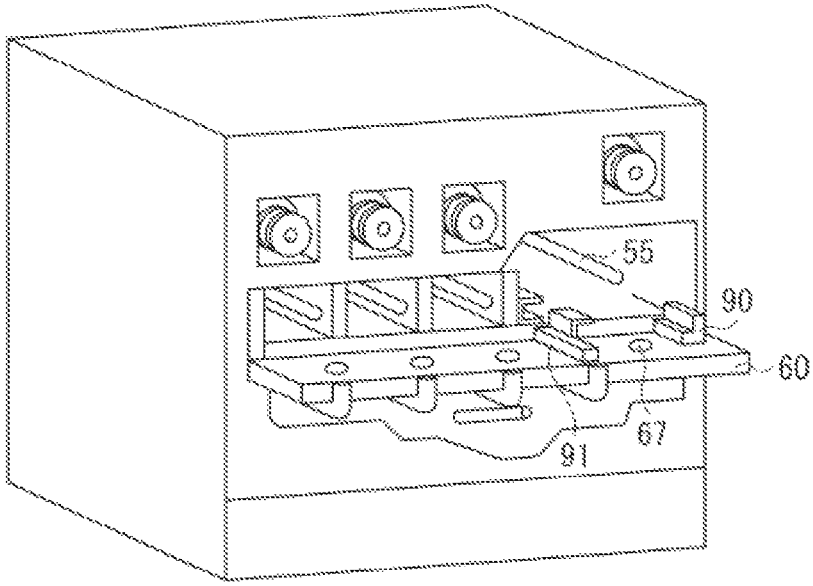

FIGS. 2A and 2B illustrate an appearance of the main body 100 of the image forming apparatus. FIG. 2A illustrates an openable/closable door 60 in its closed state. FIG. 2B illustrates the door 60 in its opened state due to operation of a lever 68. Operations to mount and remove the process cartridge 10 to and from the main body 100 are described with reference to FIGS. 2A and 2B.

The process cartridge 10 can be removed from the main body 100 by pulling down the lever 68 to move the intermediate transfer belt (ITB) unit 30 downward in the vertical direction. The lever 68 is arranged such that the front door 60 can be drawn out of the main body 100 while the lever 68 is released. In the assembled state, a drum shaft 55 is inserted in the front door 60. Thus, in opening of the front door 60, the front door 60 is drawn horizontally to the front side of the main body 100 to remove the shaft, and then rotated by 90 degrees downwardly in the vertical direction. In the opened state, guide members 90 and 91 located on the rear side of the front door 60 appear. The guide members 90 and 91 restrict the posture of the process cartridge 10 while the cartridge 10 is inserted into or removed from the main body 100. The process cartridge 10 can be removed from the main body 100 along the guide members 90 and 91.

The process cartridge 10 is inserted into the main body 100 along the guide members 90 and 91 while the drum shaft 55 passes through the rotation center of the photosensitive drum 11. In insertion and removal of the process cartridge 10, the drum shaft 55 functions to guide the process cartridge 10. Accordingly, any curve or offset of the drum shafts 55 impairs the guide function. The drum shaft 55 (drive shaft) of the main body 100 of the apparatus is provided with a coupling. The coupling is fitted with the coupling of the process cartridge 10 at a back portion of the main body 100 in the direction of the insertion of the cartridge 10. The fitted couplings constitute a coupling portion, which will be described below.

The drum shaft 55, which supports the process cartridge 10, is supported by a rear side plate of the main body 100 and the door 60 at the front side of the main body 100 along the direction of the insertion of the cartridge 10. More specifically, the door 60 is provided with a fitting hole 67, so that, when the door 60 is closed, the drum shaft 55 is inserted into the hole 67 to be supported at the proximal end thereof in the direction of the insertion of the process cartridge 10. The fitting hole 67 may be a recess of any shape that supports the shaft 55.

A drive unit, a process cartridge, and a coupling portion in the present exemplary embodiment are described in detail, which are followed by description of actions when the drum shaft is bent.

The drum drive unit 110 and the process cartridge 10 are described.

Figure 3:
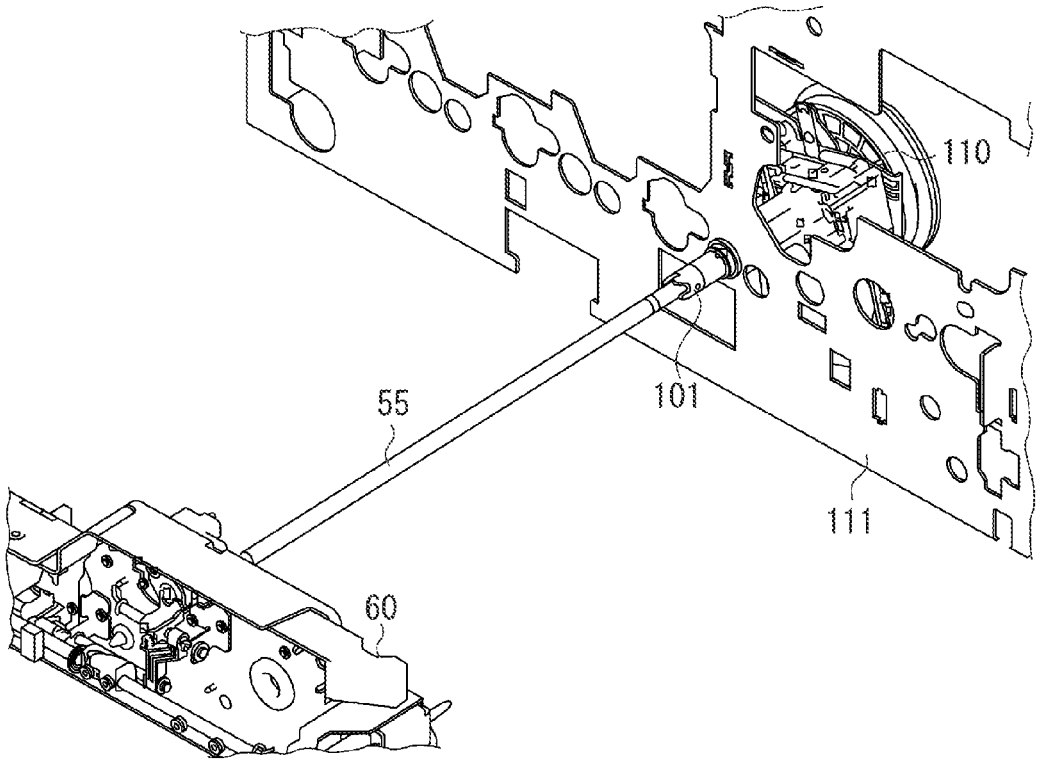
FIG. 3 is a schematic diagram illustrating a drive unit, and a rear side plate and a front door of the main body of the apparatus.

FIG. 3 illustrates a drum shaft 55 supported between the rear side plate 111 and the front door 60 of the image forming apparatus, as a drive shaft for transmitting driving force to the process cartridge 10. As seen from FIG. 3, the drum drive unit 110 is disposed on the main body of the apparatus 100, and includes a coupling 101 as a transmission member to transmit driving force to the process cartridge 10 near the rear side plate 111.

Figure 4A:
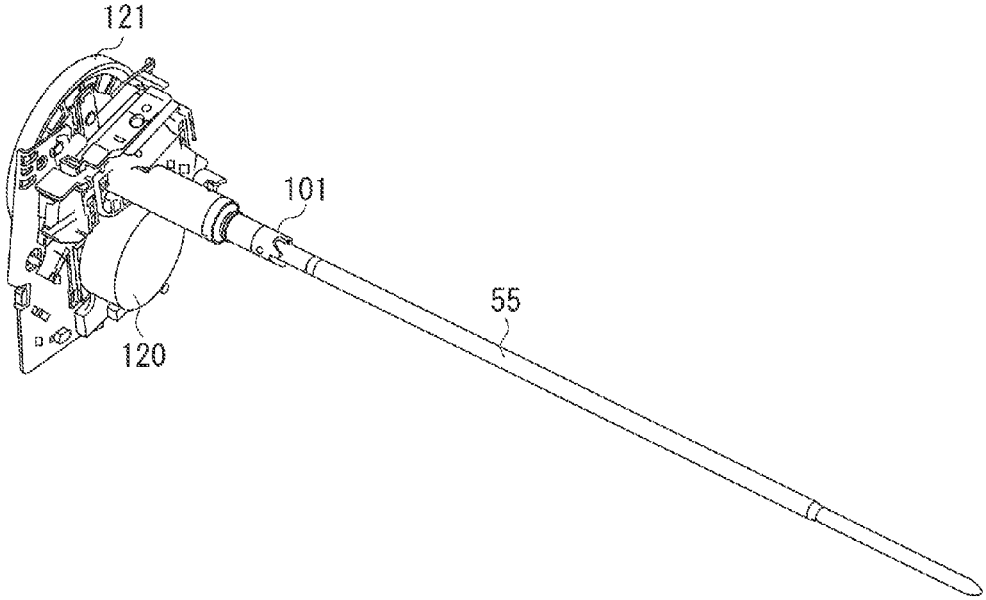
FIGS. 4A and 4B each illustrate connection between the drive unit and a cartridge.

FIG. 4A schematically illustrates the drum drive unit 110. A motor 120 generates driving force, which is received at a gear 121. The gear 121 is provided with a rotation stopper (not illustrated) relative to the drum shaft 55, and thereby the driving force is transmitted from the gear 121 to the drum shaft 55. The drum shaft 55 is provided with the coupling 101. The coupling 101 has a non-slip member relative to drum shaft 55 to integrally rotate with the drum shaft 55.

Figure 4B:
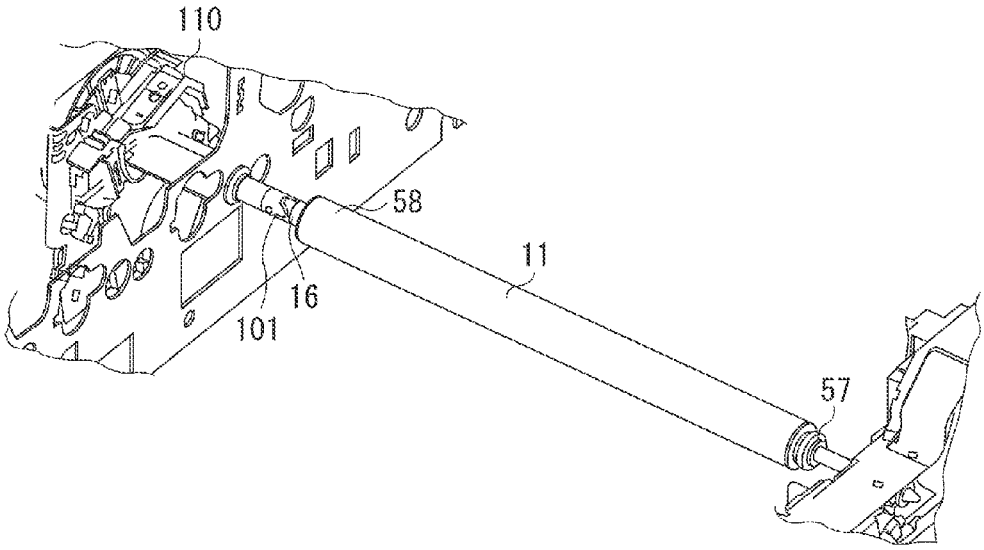

The process cartridge 10 is described. FIG. 4B illustrates the drum shaft 55 having the process cartridge 10 mounted thereto. To mount the process cartridge 10, a user opens the front door 60, and makes the drum shaft 55 pass through the rotation center of the photosensitive member 11, which is guided by the guides 90 and 91. The drum-type photosensitive member 11 has a drum flange 16 at one end thereof, the drum flange 16 having a coupling 17 as a projection of the drum flange to be in contact with the coupling 101. When the process cartridge 10 is pushed into the main body 100 of the apparatus, the two couplings (the convex coupling 17 and the concave coupling 110) are coupled to each other, constituting a pair of engaged couplings (see FIGS. 5A and 5B). This structure makes the convex coupling 17 brought into contact with the concave coupling 110 at rotation of the drum shaft 55, causing driving force to be transmitted from drum shaft 55 to the photosensitive drum 11.

Figure 5A:
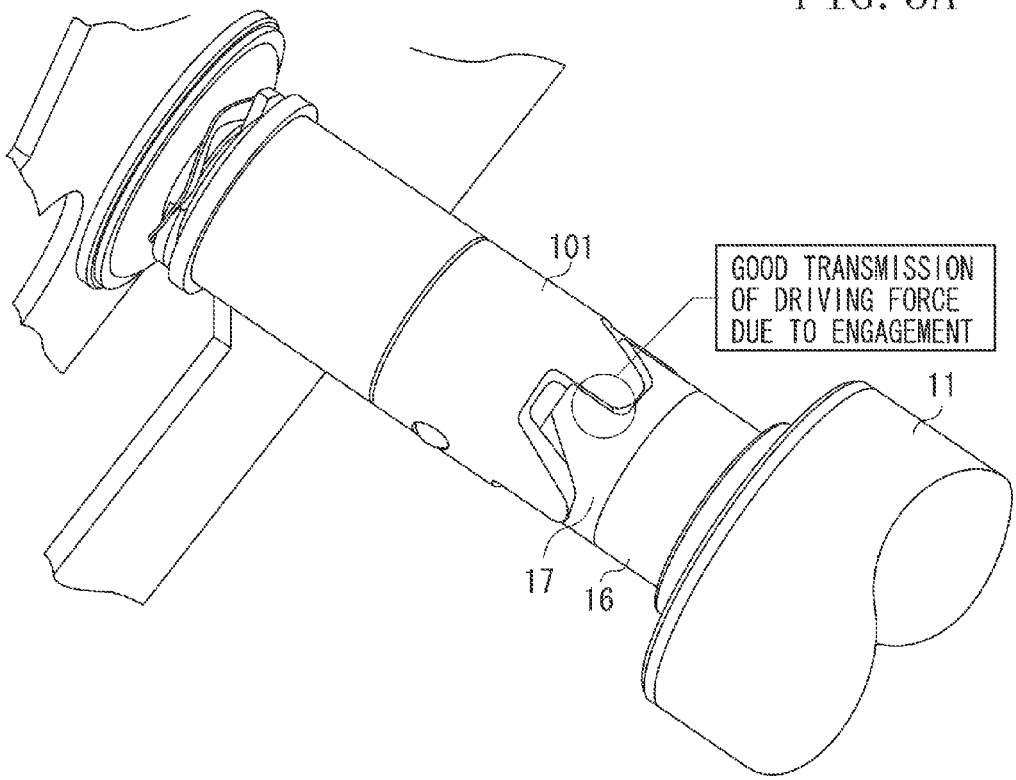
FIGS. 5A and 5B illustrate force generated at a coupling portion.
Figure 5B:
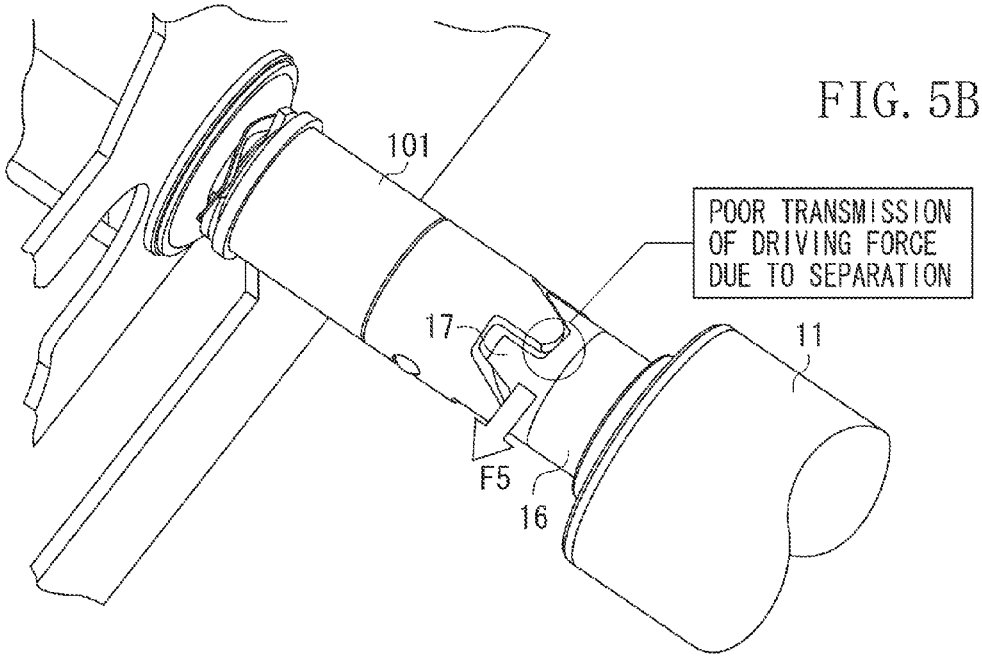

As FIGS. 5A and 5B clearly illustrate, the couplings feature their surfaces that are fitted and arranged approximately parallel to the drive shaft 55 when the couplings are rotated by the driving force of the main body of the apparatus. The arrangement enables adequate contact between the couplings and good transmission of driving force. The fitted surfaces can have slightly sloped sides so that the process cartridge 10 is pulled in toward the rear side plate by a thrust force that is generated at the surfaces under the driving force. In other words, to facilitate attachment and detachment between the couplings, the convex coupling tapers toward its distal end.

In contrast, the surface of the coupling that does not contact the other coupling under driving force has a shape that facilitates attachment of the process cartridge 10. The coupling portion is located on the side of the drum shaft opposite to the front door 60 across the process cartridge 10.

The couplings are configured to contact each other at least at three points that are positioned approximately in parallel to the drive shaft. Hereinafter, the points where the couplings are in contact with each other are referred to as connection points. The connection points can be separated from one another such that the adjacent connection points make an angle of less than 180 degrees relative to the central axis of the drive shaft.

A problem may arise in the case where the photosensitive member has a rotation speed close to a moving speed of the intermediate transfer member.

Figure 10A:
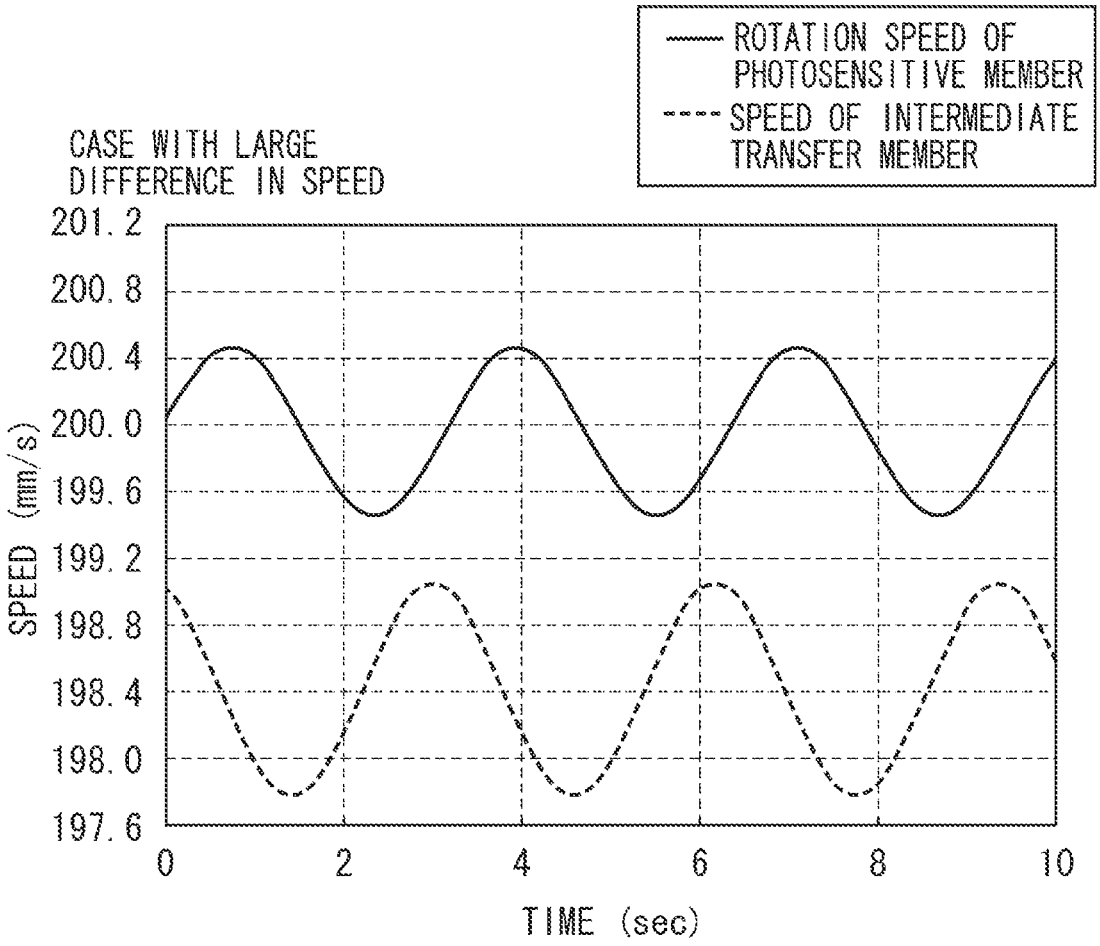
FIGS. 10A and 10B are graphs illustrating variations over time in speed of a photosensitive member and an intermediate transfer belt.
Figure 10B:
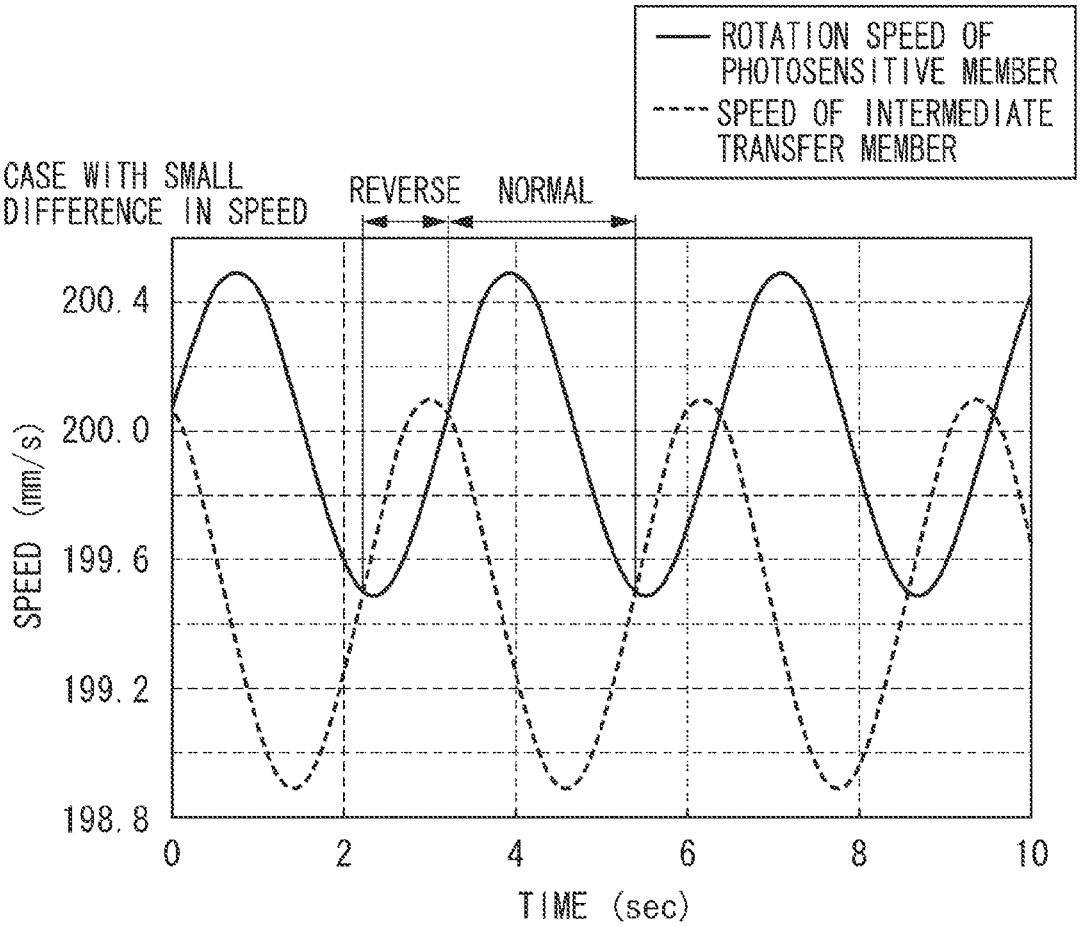

FIGS. 10A and 10B are graphs illustrating the relationship between a rotation speed of a photosensitive member on the process cartridge as a drum-type rotator and a speed of an intermediate transfer member where toner images are transferred from the photosensitive member when the intermediate transfer member contacts the photosensitive member. In the present exemplary embodiment, the surface of the photosensitive member moves faster than the intermediate transfer member (ITB) 31. This is because the ITB (intermediate transfer belt) 31 is controlled to move at a speed that prevents slack of the belt.

As illustrated in FIG. 10A, when there is a sufficient difference in speed between the photosensitive member and the intermediate transfer member, a force is unlikely to act to separate the couplings. However, a white spot at the primary transfer portions (Ta to Td) can be prevented at a minimum difference in the speed (close to zero as much as possible). Unfortunately, a reduction in the speed difference results in the state as illustrated in FIG. 10B. As seen from FIG. 10B, drive failure occurs (during the period "reverse") in the photosensitive member, due to a periodic variation in speed that is caused by component tolerances of the photosensitive member and the ITB. This happens because a faster rotation of the intermediate transfer member than that of the photosensitive member causes a force acting on the photosensitive member to momentarily separate the couplings, resulting in poor transmission of driving force from the drive shaft. The intermediate transfer member contacts sheets that pass through the secondary transfer portion. Accordingly, the sheet entrance to the secondary transfer portion may cause a slight variation in speed, in addition to that caused by the component tolerances.

FIGS. 5A and 5B are enlarged diagrams illustrating the coupling portion in detail. Under the relationship as illustrated in FIG. 10A, the couplings are constantly fitted with each other, resulting in good transmission of the driving force. During the ("reverse") period when the ITB rotates faster than the photosensitive member, however, a force F5 acts in a direction to reverse the rotation of the photosensitive drum 11 (see FIG. 5B). Due to the force F5, the coupling 101, which is a transmission member to transmit driving force from the main body 100, is separated from the coupling (projection) 17, which is a receiving member of the cartridge to receive the driving force (see FIG. 5B). The separation results in poor transmission of the rotation drive force from the drive unit to the cartridge. As a result, the photosensitive member has an unstable rotation speed, so that images are transferred from the photosensitive member as deformed images. This problem occurs even when the coupling of the apparatus main body as a transmission member is concave and the coupling of the cartridge is convex. A structure that overcomes the problem is described next in detail.

A structure that imparts a force acting against the separation force is described. As described above, a reduction in the difference in speed between the photosensitive member as a rotator and the intermediate transfer member as a transfer-receiving member that contacts the photosensitive member to receive images results in poor transmission of drive force. In the present exemplary embodiment, the drum shaft 55 as a drive shaft is bent, so that a force larger than the force F5, which is generated due to the speed variation, is applied to the coupling portion. A mechanism to bend the drive shaft and the force generated due to bending of drive shaft are described below.

A mechanism to bend the drive shaft in the present exemplary embodiment is described below. In the present exemplary embodiment, the drum shaft 55 is arranged such that the supporting point that supports the drum shaft 55 on the rear side plate side is horizontally offset from the supporting point of the drum shaft 55 on the front door side. The axial offset distance of the drum shaft 55 is described.

As illustrated in FIG. 2B, while the door 60 of the image forming apparatus is open, the drive shaft is supported at one end thereof like a cantilever beam. The door 60 is provided with a hole for supporting the shaft at the other end. The drum shaft as a drive shaft supporting the cartridge is provided with the coupling portion.

Figure 6A:
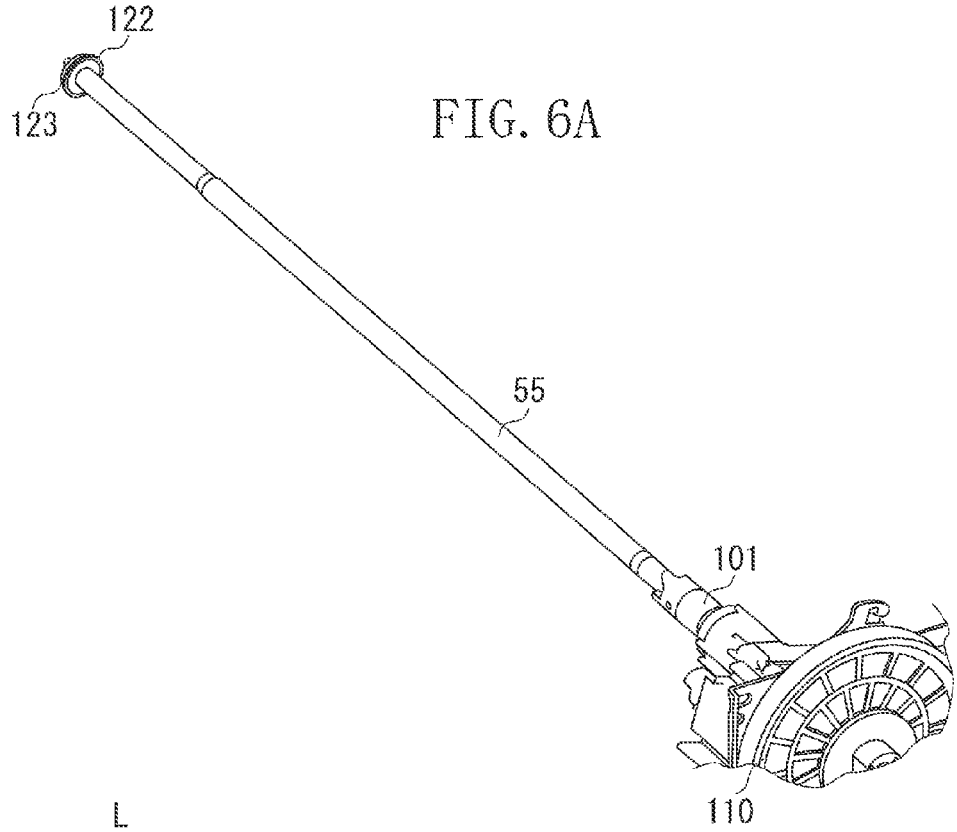
FIGS. 6A and 6B illustrate a mechanism to bend a drive shaft.
Figure 6B:
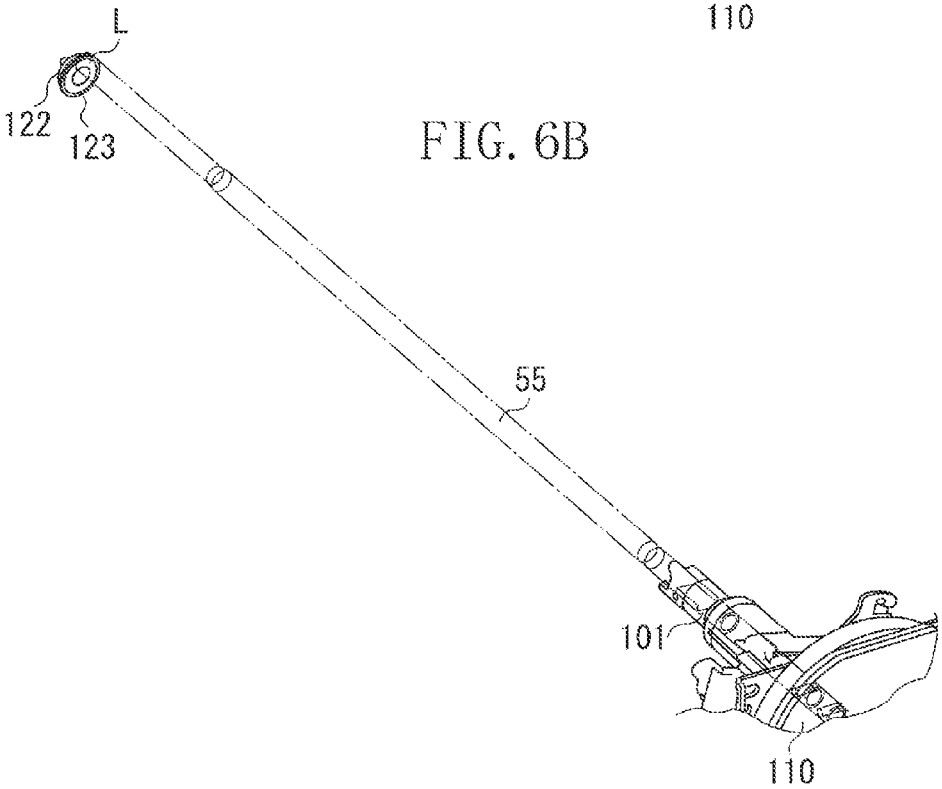

In the state illustrated in FIG. 6B (when the door is closed), the drum shaft 55 is fitted in a bearing 122. In contrast, in the state illustrated in FIG. 6A (when the door is open), the drum drive unit 110 is mounted to the main body 100 such that the distal end 123 of the drum shaft 55 is not present at the position where the distal end 123 is naturally disposed.

While the front door 60 is closed with the process cartridge 10 being mounted to the main body 100, the distal end 123 of the drum shaft 55 is held in the bearing 122. This arrangement makes the drum shaft 55 supported in a slight curved state. The deformation due to the curve generates force that deforms the flange 16 of the photosensitive drum, the flange 16 being made of a material such as resin having a relatively low rigidity. The deforming force acts in the same direction as that of the force that urges the projections 17 of the drum flange against claws 105 of the coupling. Accordingly, the projections 17 of the drum flange are not separated from the claws 105 of the coupling, but held in contact with each other, resulting in good transmission of driving force as desired. The points (a front point 57 and a rear point 58) where the photosensitive drum 11 is fitted with the drum shaft 55 are located close to the point where the drum shaft 55 is fitted with the front door 60 and the rear side plate 111, respectively. The position of the drum shaft 55 is determined by the fittings between the drum shaft 55 and the rear side plate 111 and between the drum shaft 55 and the front door 60. The fitting portion (coupling portion) between the photosensitive member and the drum shaft exists close to the determined position of the drum shaft 55, so that the curved drum shaft 55 hardly affects the generating line of the photosensitive drum 11.

In the image forming apparatus of the present exemplary embodiment, the hole in the front door is located offset downward in the direction of gravitational force from the horizontal plane including the supporting portion of the rear side plate of the main body of the apparatus where the drive shaft is supported. The drive shaft may be bent in any direction, or the axial offset of the drive shaft may be set in any direction. Either case suppresses separation of the couplings without fail. The drive shaft of the present exemplary embodiment is bent toward the transfer roller (downward in the direction of gravitational force) because bending of the shaft in the horizontal direction disturbs image exposure to form electrostatic images on the photosensitive member.

When a user closes the door 60, the bearing at the hole that has been in contact with the shaft pulls in the shaft, and makes the shaft bent. In the present exemplary embodiment, the distance between the shaft horizontally held by the supporting portion of the rear side plate and the shaft horizontally held by the door hole (hereinafter, referred to as an axial offset distance: L) is on the order of 3 to 5 mm.

In the present exemplary embodiment, couplings are configured to be engaged with each other by force generated by positional offset of the hole that supports the drive shaft. Thus, at the point of time when the front door is closed, the drive shaft is bent. However, another mechanism may be used so that the drive shaft is bent after the front door is closed. Alternatively, the drive shaft may be compressed to be bent without using the axial offset. In other words, any structure may be used as long as the structure generates force that bends the drive shaft and suppresses separation of the couplings at least during image formation.

Force applied to the drum flange when the drive shaft is bent is described below with reference to FIGS. 7A to 7C.

Figure 7A:
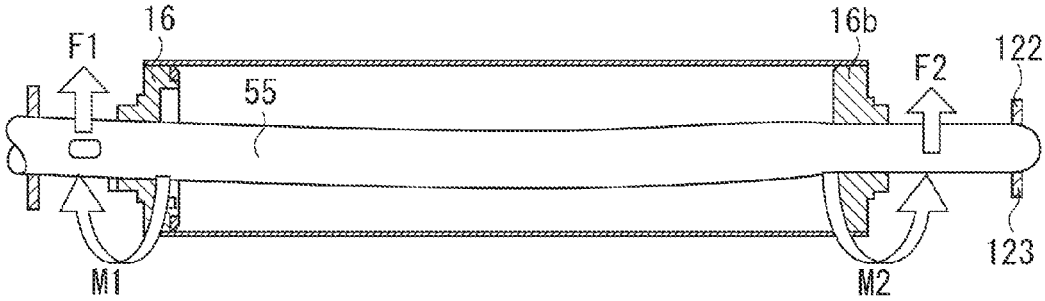
FIGS. 7A to 7C illustrate forces generated by bending the drive shaft.
Figure 7B:
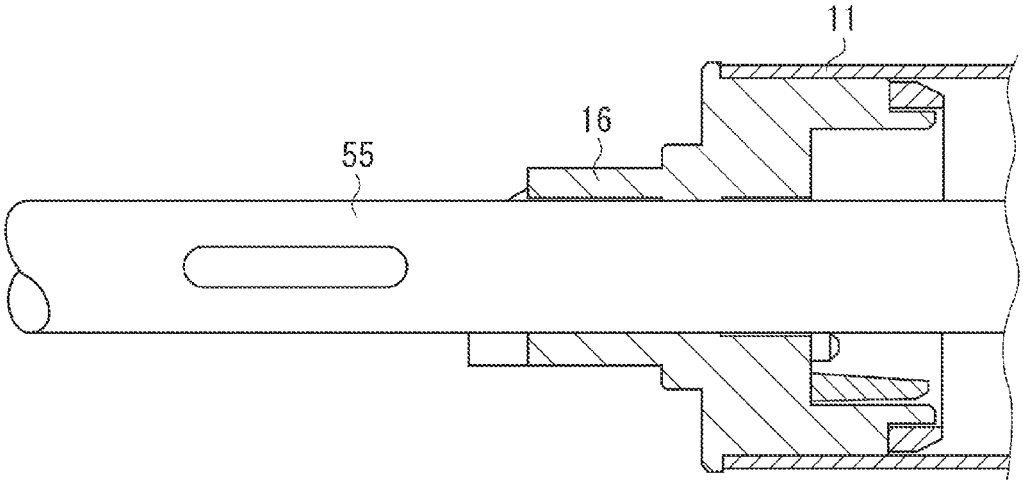
Figure 7C:
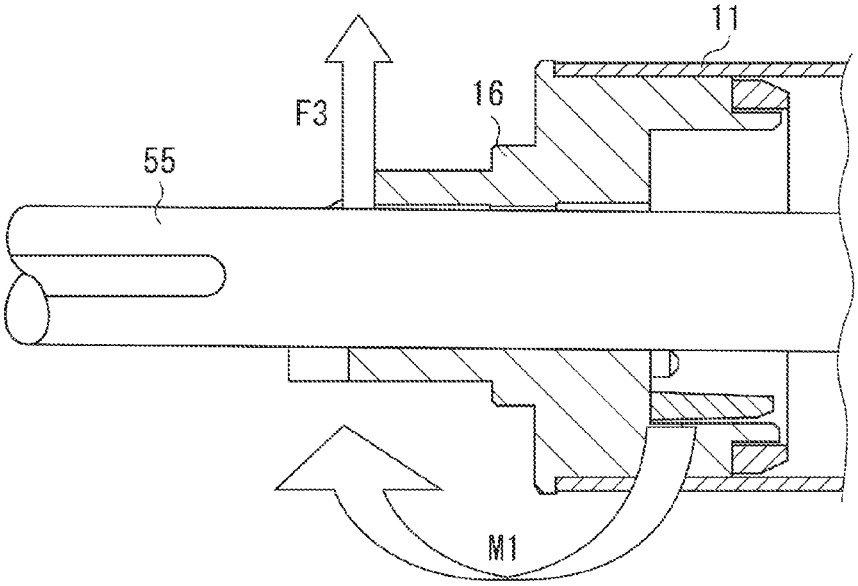

FIG. 7A is a cross sectional diagram illustrating a drum shaft, a drum, and a bearing that is fitted with the drum shaft and determines the generation line of the drum shaft, while the front door is closed. While the front door is closed, the drum shaft 55 is slightly deformed. The amount of deformation of the drum shaft 55 is in proportion to an axial offset distance L of the distal end of the drum shaft (drive shaft) from a nominal dimension. The axial offset distance L from a nominal dimension refers to the difference between the position of the shaft end without application of force from the hole (bearing) at the front door and the position of the shaft end with application of force from the bearing. The nominal dimension is equal to the size specified in figures, and accommodates a predetermined dimensional error according to the precision the apparatus requires. Conventionally, attempts have been made to suppress a variation in speed of a photosensitive member by reducing run-out tolerance of a shaft that supports the photosensitive drum. Accordingly, the drive shaft was designed to have, at the ends thereof when held, an actual dimension with a tolerance on the order of 0.0±1 mm. In terms of technical idea, a predetermined nominal dimension that does not to make the shaft bent is required. Consequently, an axial offset of a shaft by 3 mm or more in actual dimension happens only when a nominal dimension is intentionally specified to make it happen. The drum flanges 16 and 16*b* fitted around the drum shaft are simply carried (supported) by the drum shaft (see FIG. 7B). The fitting portion between the drum shaft (drive shaft) and the drum flanges has a curvature due to the curve of the drum shaft 55. Accordingly, as illustrated in FIG. 7A, forces F1 and F2 and bending moments M1 and M2 are generated near the drum flanges 16 and 16*b*, in proportion to the amount of deformation of the drive shaft 55.

The forces F1 and F2 acting on the drum shaft 55 from the drum flanges 16 do not contribute to improvement of driving. The bending moment M1 first deforms the drum flange 16. The deformation generates the force F3 in the direction toward the claws 105 of the coupling (see FIG. 7C). If the force F3 is large enough to overcome the force F5 that separates the coupling portion, the coupling portion do not get separated. If a distance of the axial offset L of the shaft is not more than that caused by component tolerance or error in assembly control, the force F3 is too small to overcome the force F5.

The coupling (connection between the coupling on the main body side and the coupling on the cartridge side) 101 is described below with reference to FIGS. 8A and 8B.

Figure 8A:
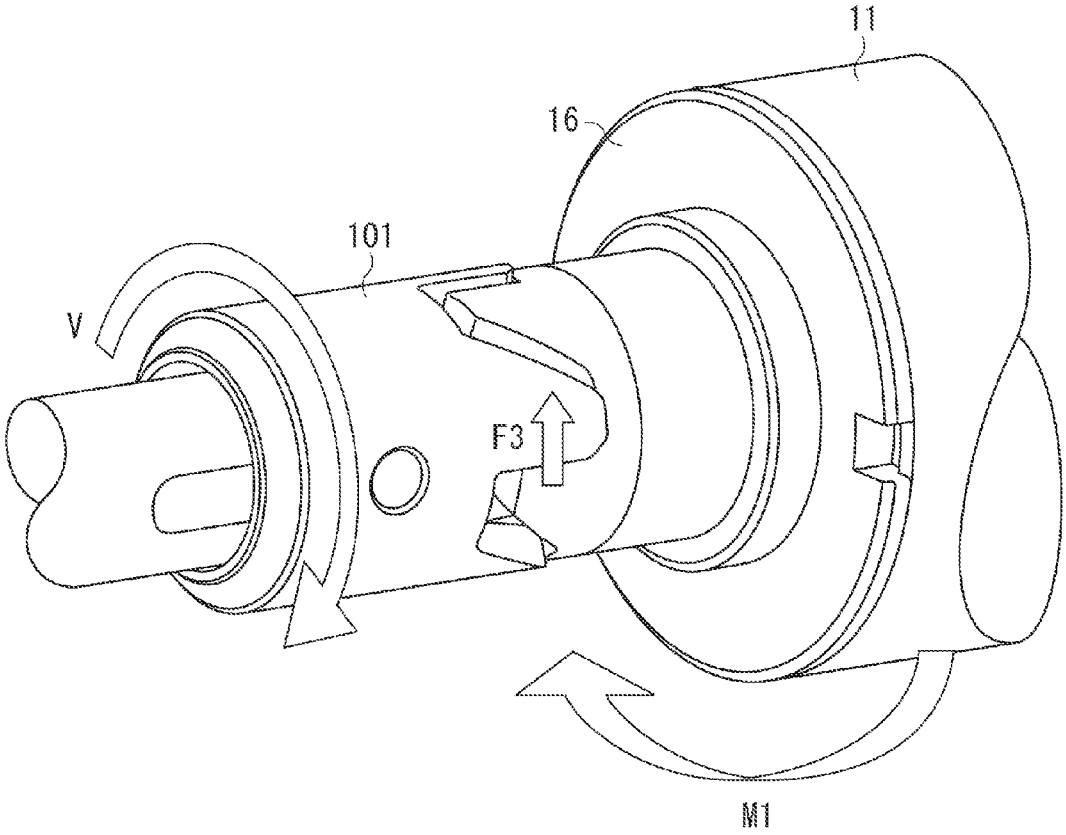
FIGS. 8A and 8B are enlarged diagram illustrating a cartridge, and a coupling portion, and a coupling member of the drive unit.
Figure 8B:
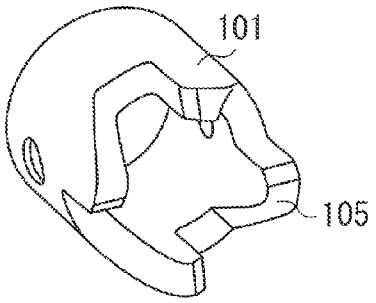

FIG. 8A is an enlarged diagram of a portion where the coupling 101 of the main body is connected to the coupling of the cartridge. As illustrates in FIG. 8A, the force F3 acts to connect the couplings together using the curve of the drive shaft even when the drive shaft rotates at a speed V. FIG. 8B illustrates the coupling (flange) 101 of the main body as a component of the coupling portion. The coupling 101 has four claws 105 as convex portions that are engaged with the concave portions of the coupling of the main body. Closing of the front door 60 makes the drum shaft 55 curved, and the quadruple claws, which mean three or more claws, are able to receive the force generated by the curving.

The deformation generated by the bending moment M1 increases as the coupling 101 has a lower rigidity. The larger deformation increases the force F3, preventing separation of the coupling portion. Thus, the coupling 101 can be made of a material having a lower rigidity than that of the drum shaft. The photosensitive drum is made of a material having a higher elastic modulus than that of the drum flange. Accordingly, even when a deforming force is applied to the flange under the force bending the shaft, the photosensitive drum keeps its shape due to the rigidity. The periodic variation in speed due to component tolerances of the photosensitive member and the intermediate transfer member is not the only factor that generates the force that separates the coupling portion. The other factors include the periodic variation in speed of the intermediate transfer member, the variation being caused when a sheet enters the secondary transfer unit to fix an image there. In this case also, good transmission of driving force can be achieved, as described above, by making the rotation speed of the photosensitive member close to that of the intermediate transfer member or making the shaft bent.

The bending of the shaft as described above generates force in the direction that prevents separation of the coupling portion, resulting in good transmission of driving force. The stability of transmission of driving force in the image forming apparatus of the present exemplary embodiment was evaluated as follows based on an amount of color misregistration in images formed on a sheet. The magnitude of force that is generated by bending the shaft and acts to prevent separation of the coupling can be conveniently controlled according to the force that is generated by a variation in speed and acts in the direction to separate the coupling.

Figure 9A:
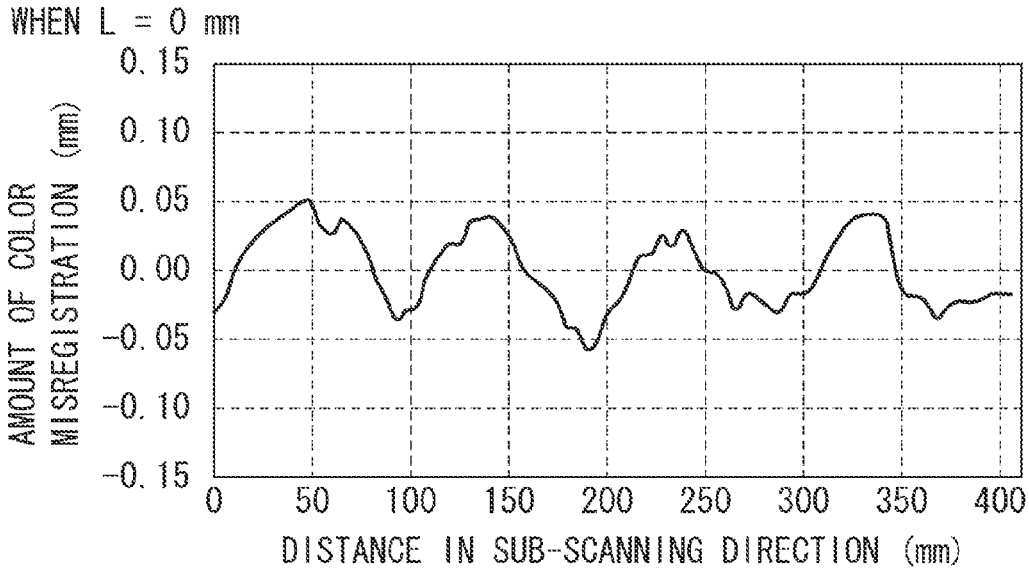
FIGS. 9A to 9C are graphs each illustrating a relationship between an axial shift amount to bend a drive shaft and an amount of color misregistration.
Figure 9B:
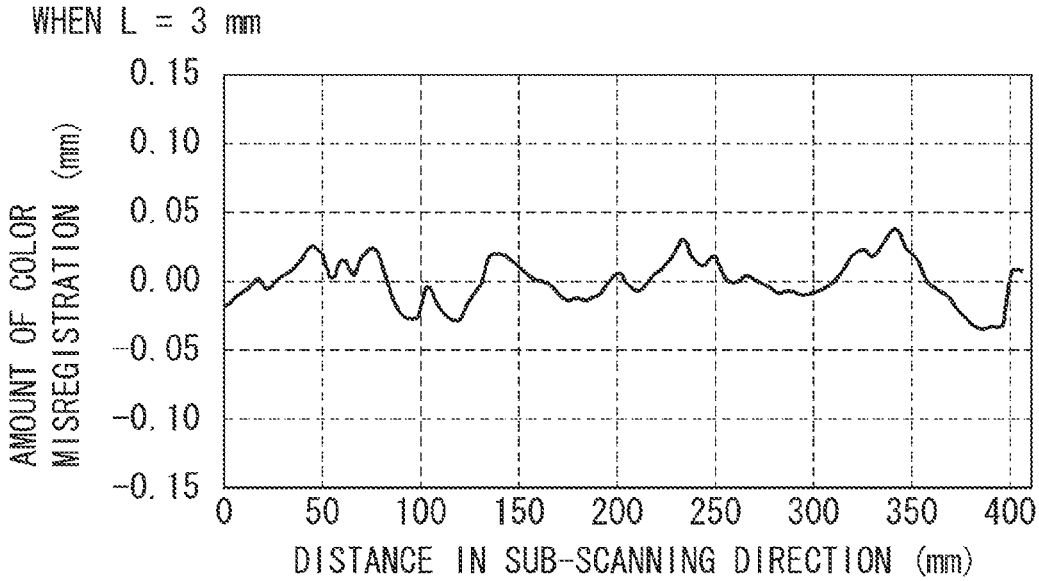
Figure 9C:
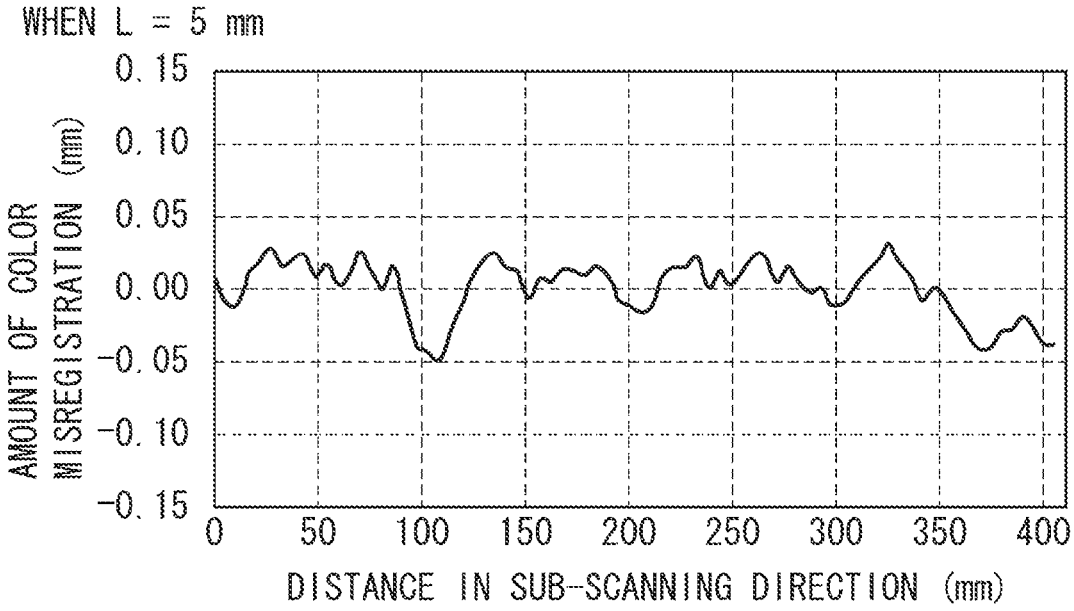

FIGS. 9A to 9C are graphs illustrating amounts of yellow color misregistration on the basis of that of black with respect to the change in an axial offset distance L of the distal end of the drum shaft from a nominal dimension. In FIGS. 9A to 9C, vertical axes represent amount (mm) of yellow color misregistration, and horizontal axes represent distance (mm) of sub-scanning in an image. The amount of color misregistration is smaller at the points closer to the 0 mm on the vertical axis, which can be evaluated as stable transmission of driving force.

FIG. 9A is a graph illustrating a case where the axial offset distance L is nominally 0 mm (actually, the shaft is offset by 0.5 mm downwardly to the right, as seen from the front side of the main body, from the center of the position where the shaft contacts when horizontally arranged). FIG. 9B is a graph illustrating a case where the axial offset distance L is nominally 3 mm (actually offset by 3.0 mm). FIG. 9C is a graph illustrating a case where the axial offset distance L is nominally 5 mm (actually offset by 4.8 mm). In FIGS. 9A and 9B, the amount of color misregistration changes at every 100 mm, which is equal to the perimeter of the process cartridge 10. Unfortunately, this change appears in the image as color misregistration. In contrast, in FIG. 9C, the color misregistration at every 100 mm does not occur, and hence there is almost no possibility that the user recognizes the misregistration as image defect.

The drum shaft 55 of the present exemplary embodiment had a length of 510 mm, and was of stainless steel (SUS) having a Young's modulus of 200 Gpa. The drum shaft 55 had a diameter of 10 mm. The drum flange 16 was of polyacetal having a Young's modulus of 2 Gpa, and had an inner diameter of 10 mm and an outer diameter of 15 mm. The fitting portion 58 between the drum shaft 55 and the drum was located at a distance of 40 mm from the fitting portion 58 between the drum shaft 55 and the rear side plate 111.

In the structure of the present exemplary embodiment to suppress a variation in speed, an axial offset distance L can be set based on the force required to be applied to the coupling portion to suppress a variation in speed occurring in the apparatus. An axial offset distance L of 5 mm is sufficient for the suppression in the present exemplary embodiment. In other words, an axial offset distance can be set through simulation or demonstration for an apparatus to be used. The manufacturing technology currently causes a component to have a dimensional tolerance and other tolerance through manufacturing steps on the order of 300 μm and a fitting play on the order of 10 to 30 μm. Thus, a structure including about 5 components that may affect an axial offset distance L will have a tolerance of about 2 mm at the maximum, hence a tolerance over 3 mm is unlikely to occur in the structure. In addition, a reduction in the number of components is commonly promoted to increase easiness of product assembly and decrease variation in precision of the products. As a result, there cannot be a structure having 10 or more components therein. The tolerance through manufacture processes totals about 2 mm to 3 mm at the maximum. Therefore, an axial offset distance L of 5 mm can be achieved only by intentional design.

In the present exemplary embodiment, the drum shaft is bent using a hole provided in the front door of the apparatus main body. The drum shaft, however, may be bent using another mechanism. More specifically, the drum shaft as a drive shaft may have a length longer than the distance between the front door 60 and the rear side plate of the apparatus, so that the drum shaft is bent. In the present exemplary embodiment, the drum shaft is bent by closing the front door, but this is merely illustrative and not limiting the bending mechanism to a structure that is linked to opening/closing of the front door. For example, a lever may be used to bend the drive shaft.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-108784 filed May 10, 2010, which is hereby incorporated by reference herein in its entirety.

What is claimed is:

1. An image forming apparatus comprising:

a main body;

a cartridge including an image bearing member rotatably disposed thereon and being detachably mounted to the main body;

a first engagement portion rotatably disposed on a side of the main body and including a plurality of first engagement claws for inputting a drive into the cartridge;

a shaft passing through the image bearing member and rotatably disposed with the first engagement portion;

a second engagement portion disposed on a side of the cartridge and including a plurality of second engagement claws to engage with the plurality of first engagement claws;

an intermediate transfer member configured to come into contact with the image bearing member and to be rotated so that an image formed on the image bearing member is transferred to the intermediate transfer member; and an urging portion configured to urge one of the first engagement portion and the second engagement portion against an other of the first engagement portion and the second engagement portion so that at least one of the plurality of first engagement claws and at least one of the plurality of second engagement claws engage with each other in a rotation direction, regardless of a phase of the first engagement portion, wherein the urging portion includes a positioning portion configured to position the shaft, and wherein the urging portion is configured to urge one of the first engagement portion and the second engagement portion against the other of the first engagement portion and the second engagement portion by bending the shaft with the positioning portion.

2. The image forming apparatus according to claim 1, wherein the positioning portion is configured to position the shaft so that one end of the shaft is not coaxial with an other end of the shaft.

3. The image forming apparatus according to claim 1, wherein an angle between adjacent claws of the first engagement portion is less than 180 degrees, and wherein an angle between adjacent claws of the second engagement portion is less than 180 degrees.

* * * * *